US008827848B1

(12) United States Patent
Washburn et al.

(10) Patent No.: US 8,827,848 B1
(45) Date of Patent: Sep. 9, 2014

(54) ILLUMINATED BADMINTON PLAY SET

(76) Inventors: Ebbie Washburn, Clinton, MO (US); Ronald Fabian Letcher, Warsaw, MO (US)

( * ) Notice: Subject to any disclaimer, the term of this patent is extended or adjusted under 35 U.S.C. 154(b) by 420 days.

(21) Appl. No.: 13/068,964

(22) Filed: May 25, 2011

Related U.S. Application Data

(60) Provisional application No. 61/347,858, filed on May 25, 2010.

(51) Int. Cl.
*A63B 67/18* (2006.01)

(52) U.S. Cl.
USPC ..... 473/490; 473/473; 473/474; 473/570

(58) Field of Classification Search
USPC ..... 473/490, 465, 473, 570, 47
See application file for complete search history.

(56) References Cited

U.S. PATENT DOCUMENTS

| | | | | |
|---|---|---|---|---|
| 3,971,560 | A * | 7/1976 | Panosh | 473/475 |
| 5,417,438 | A * | 5/1995 | Poff | 473/415 |
| 5,562,290 | A * | 10/1996 | Wei | 473/570 |
| 5,595,388 | A * | 1/1997 | Swigart | 473/465 |
| 5,720,651 | A | 2/1998 | Chien | |
| 6,142,894 | A | 11/2000 | Lee | |
| 6,168,541 | B1 * | 1/2001 | Gibbs | 473/497 |
| 6,769,795 | B1 * | 8/2004 | Hale | 362/396 |
| 6,780,130 | B1 * | 8/2004 | Monochello | 473/570 |
| 7,258,635 | B2 | 8/2007 | Brandes | |
| 7,798,922 | B2 * | 9/2010 | Oresky | 473/490 |
| 2003/0144090 | A1 * | 7/2003 | Belik | 473/473 |
| 2004/0220001 | A1 * | 11/2004 | Oister et al. | 473/570 |
| 2006/0199683 | A1 * | 9/2006 | Brandes | 473/579 |
| 2008/0139347 | A1 * | 6/2008 | Liao | 473/549 |
| 2008/0254920 | A1 * | 10/2008 | Oresky | 473/490 |
| 2009/0197710 | A1 * | 8/2009 | Ronda | 473/490 |
| 2012/0065006 | A1 * | 3/2012 | Vogt | 473/490 |
| 2013/0040767 | A1 * | 2/2013 | Gill | 473/465 |

* cited by examiner

*Primary Examiner* — Raleigh W Chiu
(74) *Attorney, Agent, or Firm* — Robert C. Montgomery; Montgomery Patent & Design

(57) ABSTRACT

A badminton play set in which all components is illuminated, comprising a boundary line, a net, a pair of racquets, and a shuttlecock. The play set provides a means for participating in the game of badminton during not only daytime, but also nighttime via an illumination means on each component of said play set.

12 Claims, 9 Drawing Sheets

ILLUMINATED BADMINTON PLAY SET

RELATED APPLICATIONS

The present invention was first described in and claims the benefit of U.S. Provisional Application No. 61/347,858 filed May 25, 2010, the entire disclosure of which is incorporated herein by reference.

FIELD OF THE INVENTION

The present invention relates generally to badminton, and in particular, to an illuminated badminton game system.

BACKGROUND OF THE INVENTION

Lawn games such as horseshoes, lawn darts, croquet, volleyball, and badminton are popular outdoor recreational activities for small residential gathering. They are particularly popular during parties and picnics. While such games are indubitably fun, they are primarily intended for use during daytime hours. In fact, many of these games are actually dangerous when played with low visibility such as during nighttime hours.

Even when safety concerns are minimal, it is extremely difficult to see various game components in the dark. Most such games rely heavily on a visual component to allow participants to either aim for a target or react to an opponent's move. Even in the presence of artificial lighting such as streetlights, torches, floodlights, and the like, depth perception is hindered and some areas of a yard are not as well lit as others. Most lawn games include small game pieces, and such pieces become lost easily in the unlit areas. As pieces are lost, the game becomes less and less interesting and provides an increased burden when trying to locate the pieces the next day.

Due to the abovementioned factors, most such games typically stop when it becomes dark. However, this is less than ideal, because parties and gatherings often extend well into the night, leaving the participants searching for activities to replace those games.

Various attempts have been made to provide lighted games. Examples of these attempts can be seen by reference to several U.S. Patents and U.S. Patent Applications, such as U.S. Patent Application No. 2004/0220001, U.S. Pat. No. 5,417,438, U.S. Pat. No. 5,562,290, U.S. Pat. No. 5,595,388, and U.S. Pat. No. 6,780,130. However, none of these designs are similar to the present invention.

While these devices fulfill their respective, particular objectives, each of these references suffer from one (1) or more of the aforementioned disadvantages. Many such devices do not provide illumination for all of the components necessary to play a game. Many such devices rely solely on expendable energy sources. Many such devices do not provide illumination to the area around the game. Accordingly, there exists a need for a badminton game system without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a badminton game system with all expected features of a badminton set and providing visibility to all of the game's components and the area of play for nighttime use. Thus, the object of the present invention is to solve the aforementioned disadvantages and provide for this need.

To achieve the above objectives, it is an object of the present invention to provide an illuminated badminton play set for participating in the game of badminton during either daytime hours or during periods of low visibility such as cloudy weather or nighttime. The system includes a boundary line, a net, a plurality of racquets, and a shuttlecock.

Another object of the present invention is to provide illumination to all of the components of the system.

Yet still another object of the present invention is to illuminate the entire boundary of the play area with the boundary line and a plurality of boundary line illumination means. The boundary is a translucent plastic tube and the plurality of boundary line illumination means is preferably a plurality of light-emitting diodes (LED's).

Yet still another object of the present invention is to provide both corded and battery power sources for the boundary line with a boundary line power cord and a user-replaceable boundary line secondary battery source. The boundary line further includes a power switch for activating or deactivating the boundary line, so that the boundary line can be used during daylight in a common manner and quickly activated at any point as daylight fades to increase visibility.

Yet still another object of the present invention is to illuminate a perimeter of the net with a length of net tube and a plurality of net illumination means. The net tube is a translucent tube similar to the boundary line and molded to the perimeter of the net. The net tube houses the net illumination means spaced throughout the tube.

Yet still another object of the present invention is to provide both corded and battery power sources for the net illumination means by routing the net tube through a net support pole and downwardly to a ground surface for connection to either an existing residential power supply or standalone operation from a net secondary battery power source. The net has a net power switch similar to the boundary line.

Yet still another object of the present invention is to illuminate each racquet during use with a plurality of racquet illumination means spaced around a perimeter of a head of the racquet. A frame of the head is constructed of a transparent or translucent material that houses the racquet illumination means and allows them to be seen during use.

Yet still another object of the present invention is to power the racquet illumination means with a racquet power source comprising a replaceable battery stowed within a handle of each racquet. The battery is accessed by removing a cap from an end of the racquet handle and actuated by a racquet power switch located on the cap. The racquet power switch is located such that it can be quickly actuated during use but will not be contacted during normal use of the racquet while playing badminton.

Yet still another object of the present invention is to provide an illuminated shuttlecock comprising an internal shuttlecock illumination means housed within the shuttlecock and a translucent rubber or plastic base that enables users to see the shuttlecock illumination means during use.

Yet still another object of the present invention is to power the shuttlecock illumination means with a small, replaceable integral battery. The battery is accessed by threadingly removing the base from a skirt portion of the shuttlecock. The battery can further be removed to utilize the shuttlecock as a common, un-illuminated shuttlecock.

Yet still another object of the present invention is to provide a waterproof construction of the boundary line, net tube, racquets, and shuttlecock to prevent damage in the presence of precipitation.

Yet still another object of the present invention is to provide a method of utilizing the device that provides a unique means of acquiring the boundary line, net, racquets, and shuttlecock, installing the boundary line and net in a common manner, plugging in the corded power sources of the boundary line and net if desired, providing a battery for each of the components, utilizing the system to play badminton in a common manner, selectively providing illumination to one (1) or more components of the system to increase visibility, replacing the batteries as necessary, and providing visibility to the spatially significant components of a badminton game in order to play badminton during periods of low visibility in a full and uninhibited manner.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | illuminated badminton play set |
| 15 | illumination |
| 20 | boundary line |
| 21 | boundary line tube |
| 22 | boundary line illumination means |
| 23 | spike |
| 24 | boundary line power cord |
| 25 | boundary line battery compartment |
| 26 | boundary line secondary power source |
| 30 | net |
| 31 | pole |
| 32 | netting |
| 33a | net attachment cord |
| 33b | hook |
| 34 | net cord aperture |

-continued

| DESCRIPTIVE KEY | |
|---|---|
| 35 | pole spike |
| 36 | border |
| 37 | net tube |
| 38 | net illumination means |
| 39 | net tube aperture |
| 40 | net power cord |
| 41 | net battery compartment |
| 42 | net secondary power source |
| 44 | string |
| 45 | racquet |
| 46 | handle |
| 47 | racquet switch |
| 48 | head |
| 49 | cap |
| 50 | cap threaded portion |
| 51 | handle internal portion |
| 52 | racquet power source |
| 53 | racquet illumination means |
| 54 | stem |
| 55 | shuttlecock |
| 56 | base |
| 57 | shuttlecock illumination means |
| 58 | skirt |
| 59 | skirt threaded portion |
| 60 | shuttlecock power source |
| 61 | base threaded portion |
| 62 | attachment member |
| 63 | base attachment |
| 64 | skirt attachment |
| 65 | center grip member |
| 66 | illumination means aperture |
| 70 | electrical wiring |
| 71 | tube power switch |
| 72 | net power switch |
| 75 | playing area |

DETAILED DESCRIPTION OF THE PREFERRED EMBODIMENT

In accordance with the invention, the best mode is presented in terms of a preferred embodiment, herein depicted within FIGS. 1 through 9. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes an illuminated badminton play set (herein described as the "system") 10, which provides a means for participating in the game of badminton preferably during nightfall or in less than desirable lighting situations, yet may also be utilized during daylight hours.

Figure 1:
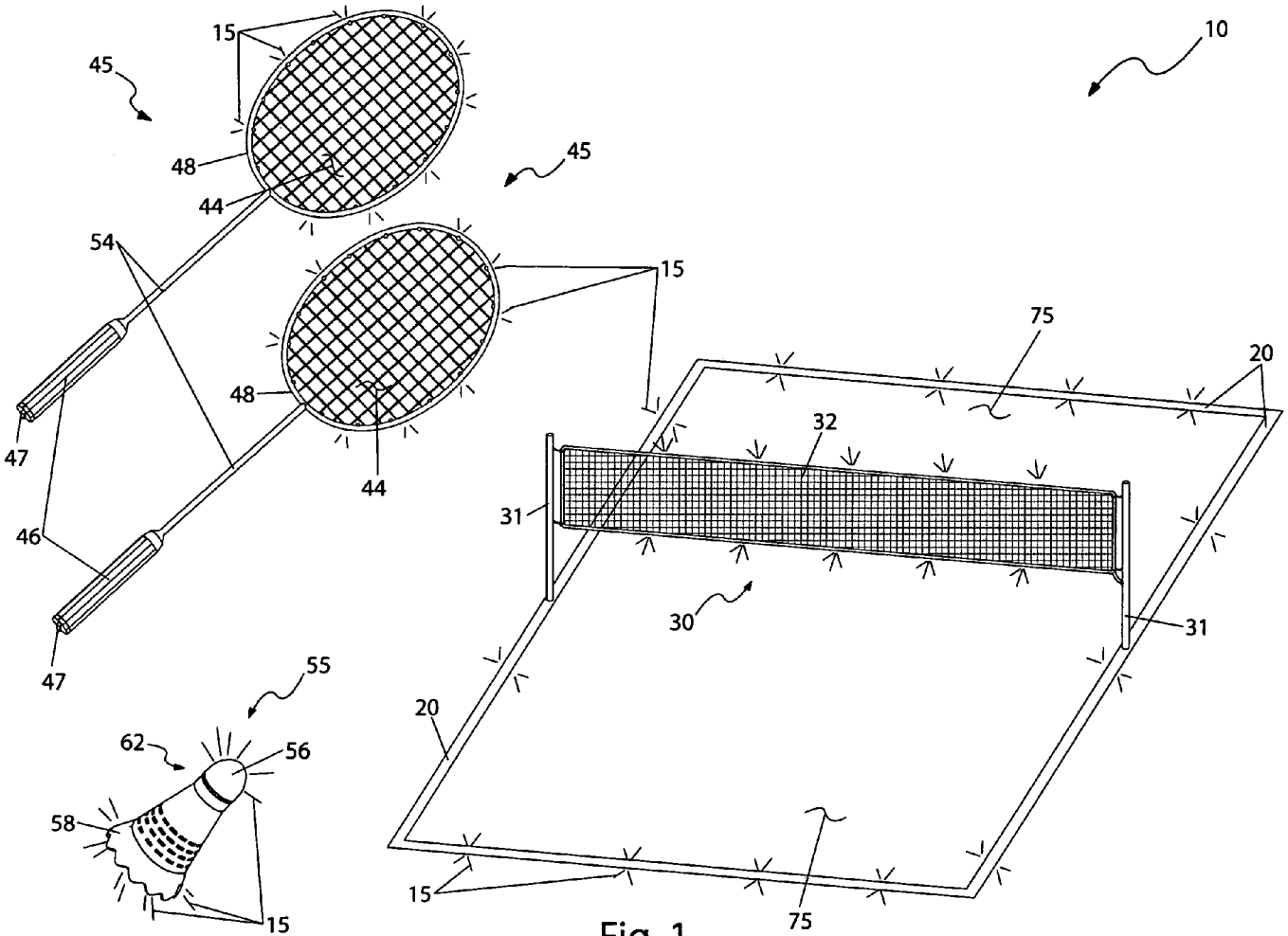
FIG. 1 is an isometric view of an illuminated badminton play set 10, according to a preferred embodiment of the present invention.

Referring now to FIG. 1, an isometric view of the system 10, according to the preferred embodiment of the present invention, is disclosed. The system 10 comprises a boundary line 20, a net 30, a pair of racquets 50, and a shuttlecock 50. The system 10 provides a user with all components needed to play the game of badminton in which all the components comprise an illumination means 15 which enable a desired playing area 75 to illuminate and also to enable play of the game to continue in the less than desirable lighting situations.

Figure 2:
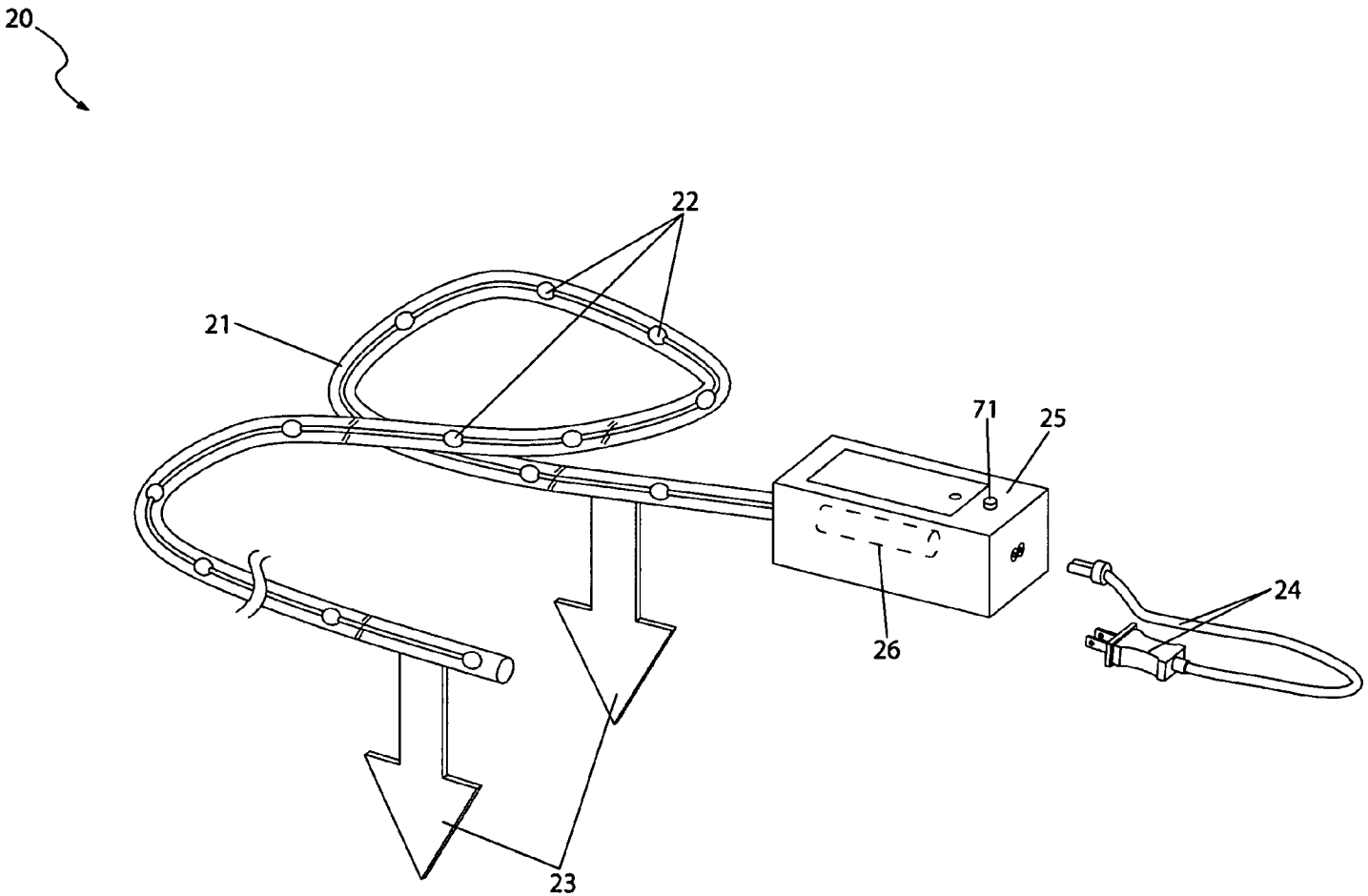
FIG. 2 is a perspective view of a boundary line 20, according to a preferred embodiment of the present invention.

Referring now to FIG. 2, a perspective view of the boundary line 20, according to the preferred embodiment of the present invention, is disclosed. The boundary line 20 enables the player or players to know the inbound and out-of-bound areas. The boundary line 20 provides the system 10 with a playing area 75 of approximately twenty (20) feet wide by forty (40) feet long. The boundary line 20 is depicted in FIG. 1 as a single unit for illustration purposes only, yet it is known that a pair of boundary lines 20 may be utilized to create the desired playing area 75 dimension. The boundary line 20 provides an illumination 15 to the playing area 75 and is preferably fabricated from common rope lighting which includes a length of translucent and plastic boundary line tube 21. The boundary line tube encloses a length of boundary line illumination means 22 which preferably light-emitting diodes (LED's), yet other illumination means may be utilized. A lower exterior surface of the boundary line tube 21 preferably includes a plurality of equally spaced spikes 23 which enable the boundary line 20 to secure to the desired ground surface. Each spike 23 is fabricated from plastic and integrally molded to the boundary line tube 21.

The boundary line illumination means 22 is powered via a boundary line power cord 24 which is plugged into a boundary line battery compartment 25 and further to be inserted into a common household circuit. The boundary line power cord 24 may be removed to enable a boundary line secondary power source 26 which is preferably a plurality of appropriate and common user-replaceable batteries to power the boundary line illumination means 22 in lieu of the boundary line power cord 24. The boundary line battery compartment 25 would include housing which encloses a transformer circuit and sensing relays which enable the power source to switch from the boundary line power cord 24 or the boundary line secondary power source 26 as desired. When the boundary line secondary power source 26 is utilized alone, a tube power switch 71 upon the boundary line battery compartment 25 is depressed to activate or deactivate the boundary line illumination means 22. The tube power switch 71 is depicted as a common pushbutton, yet other switching devices may be utilized without limiting the scope of the system 10.

Figure 3:
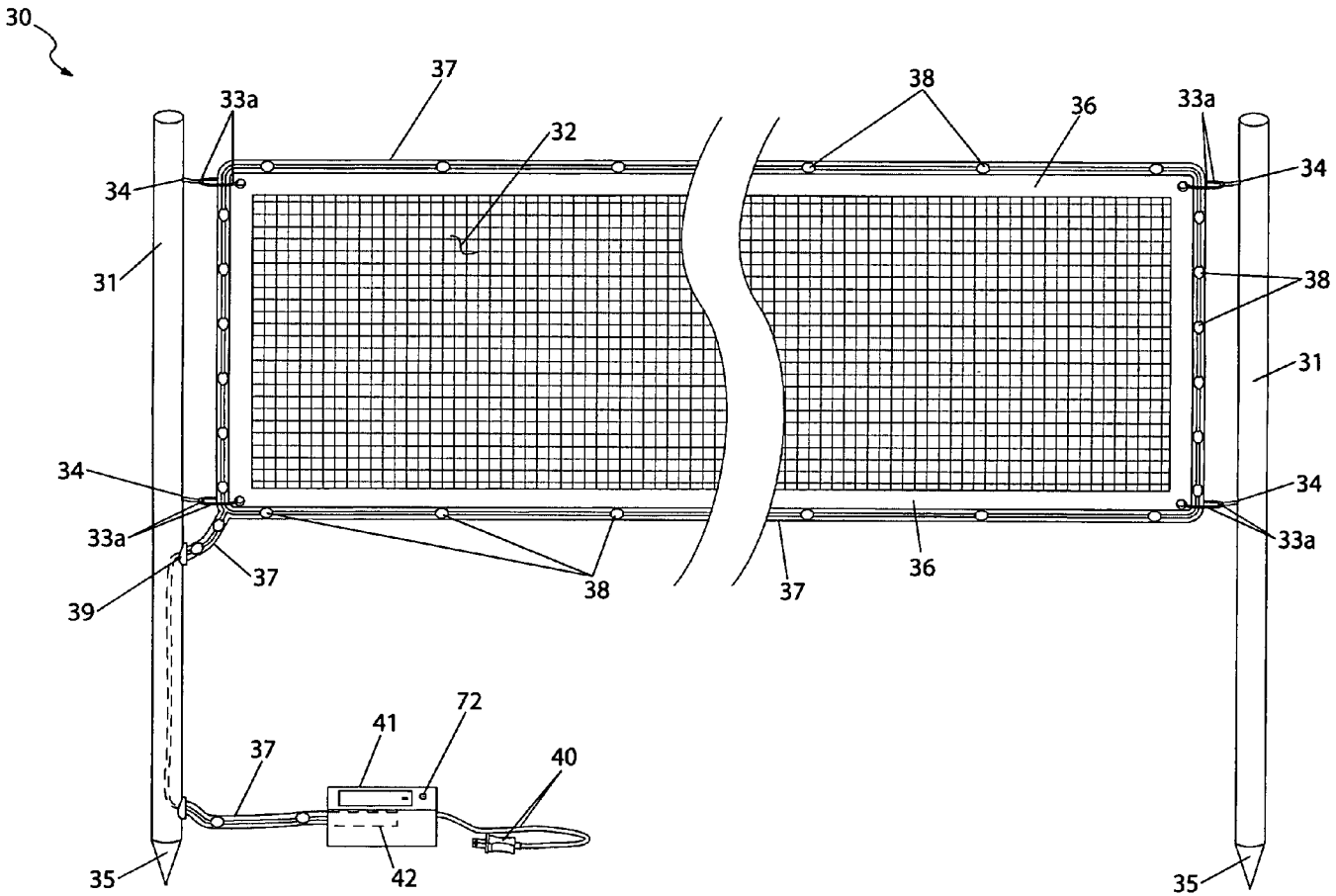
FIG. 3 is a perspective view of a net 30, according to a preferred embodiment of the present invention.
Figure 4:
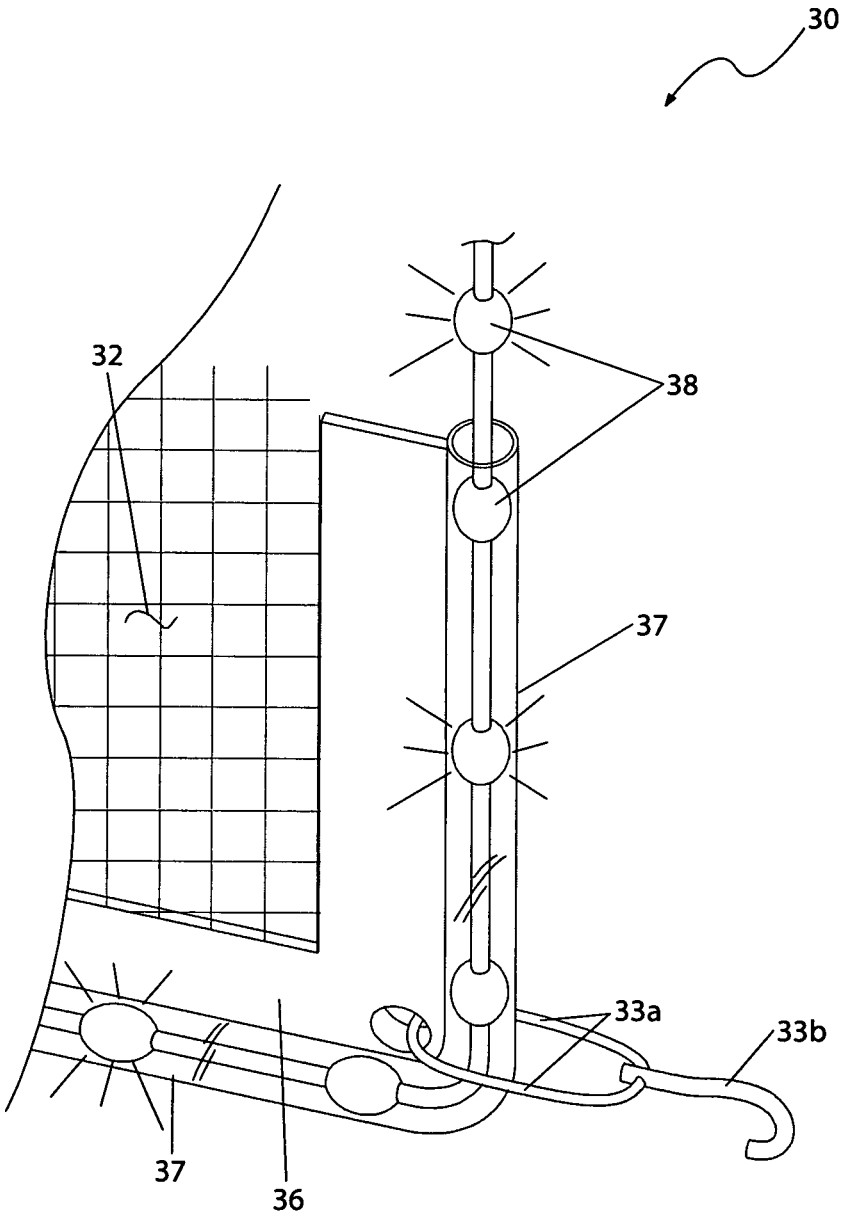
FIG. 4 is a close-up perspective view of the net 30, according to a preferred embodiment of the present invention.

Referring now to FIG. 3, a perspective view of the net 30 and FIG. 4, a close-up perspective view of the net 30, according to the preferred embodiment of the present invention, are disclosed. The system 10 also comprises a net 30 providing a division between the playing areas 75 as to divide a pair of teams or players. The net 30 is suspended above and spans the distance between parallel longitudinal runs of the deployed boundary line 20 via a pair of poles 31 which are located on opposing sides of the net 30. The poles 31 are approximately five (5) feet in length and are fabricated from materials such as, but not limited to: plastic, metal, or the like. The poles 31 are preferably positioned into the ground of a level playing area 75 via a pole spike 35 which is integrally attached upon a proximal end surface of each pole 31 to enable the net 30 to be erected and pulled taut. The net 30 comprises a border 36 to secure netting 32 and a length of net tube 37. The border 36 also enables a net attachment cord 33*a* and hook 33*b* to be strung through each corner of the border 36 to fasten the border 36 and netting 32 to each pole 31 via inserting the net attachment cord 33*a* through a respective net cord aperture 34. The netting 32 is preferably sewn into the border 36 and envelops the entire internal area of the border 36 to prohibit the shuttlecock 55 (see FIG. 8) from passing through. The netting 32 preferably fabricated from materials such as, but not limited to: mesh, nylon, fiber optics, or the like in a crisscrossed matrix orientation.

A length of a net tube 37 is attached to the exterior perimeter edge of the border 36 via common molding techniques to provide additional illumination 15 to the playing area 75. The net tube 37 is similar to the abovementioned boundary line tube 21 in that it is preferably a common rope lighting which is comprised of a plastic tube which encompasses length of net illumination means 38. The net illumination means 38 is preferably LED's routed within the net tube 37. The net tube 37 is routed through a pair of net tube apertures 39 upon a pole 31 which further interconnects the net illumination means 38 to a net power cord 40 and net secondary power source 42 which enables current to be sent via a common household circuit or user replaceable batteries, respectively. The net secondary power source 42 is housed within a net battery compartment 42 which is similar as the abovementioned boundary line battery compartment 25. When the net secondary power source 42 is utilized alone a net power switch 72 which is similar to the abovementioned net power switch 72 upon the net battery compartment 41 is depressed to activate or deactivate the net illumination means 38.

Figure 5:
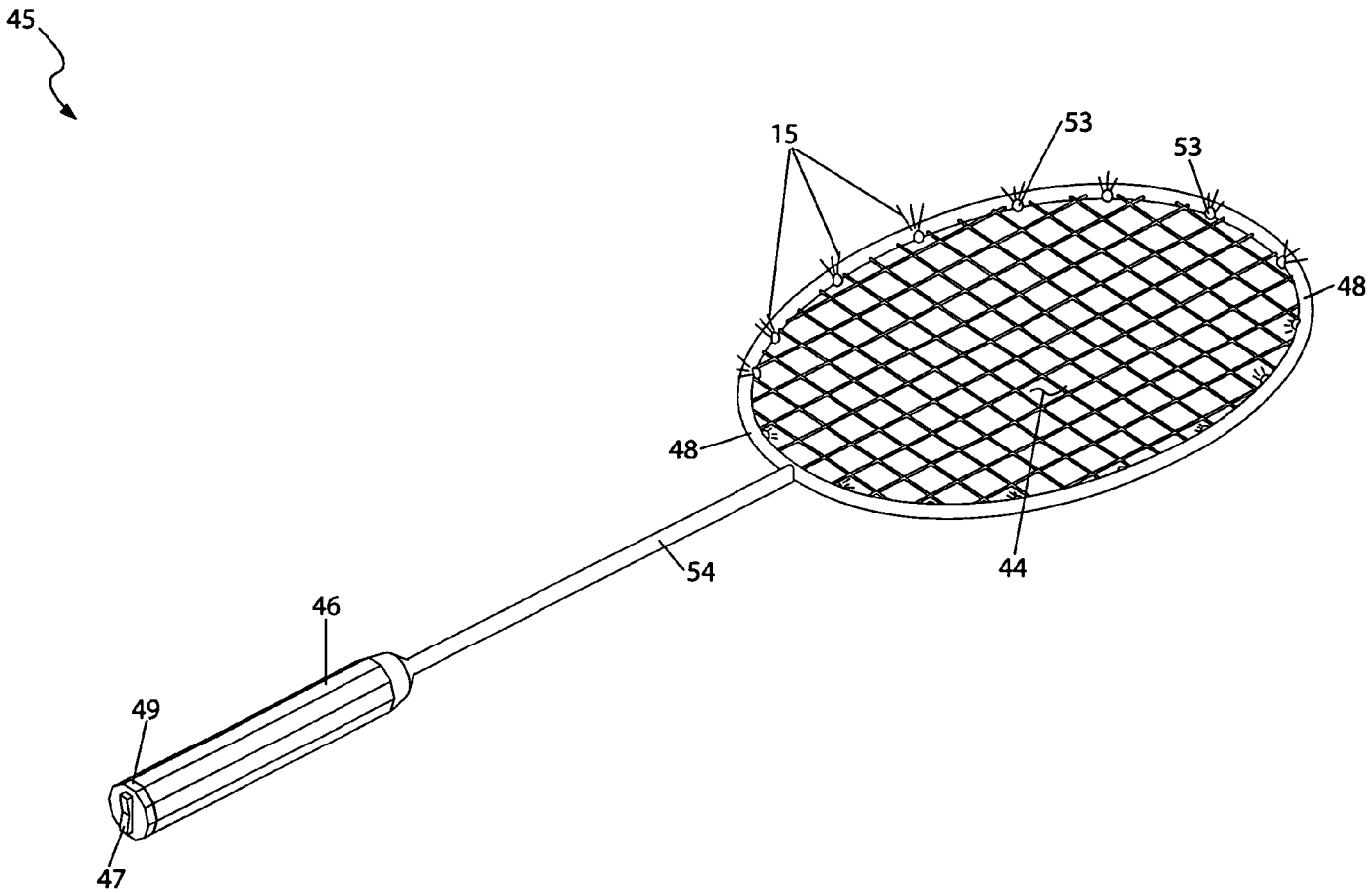
FIG. 5 is a perspective view of a racquet 45, according to a preferred embodiment of the present invention.
Figure 6:
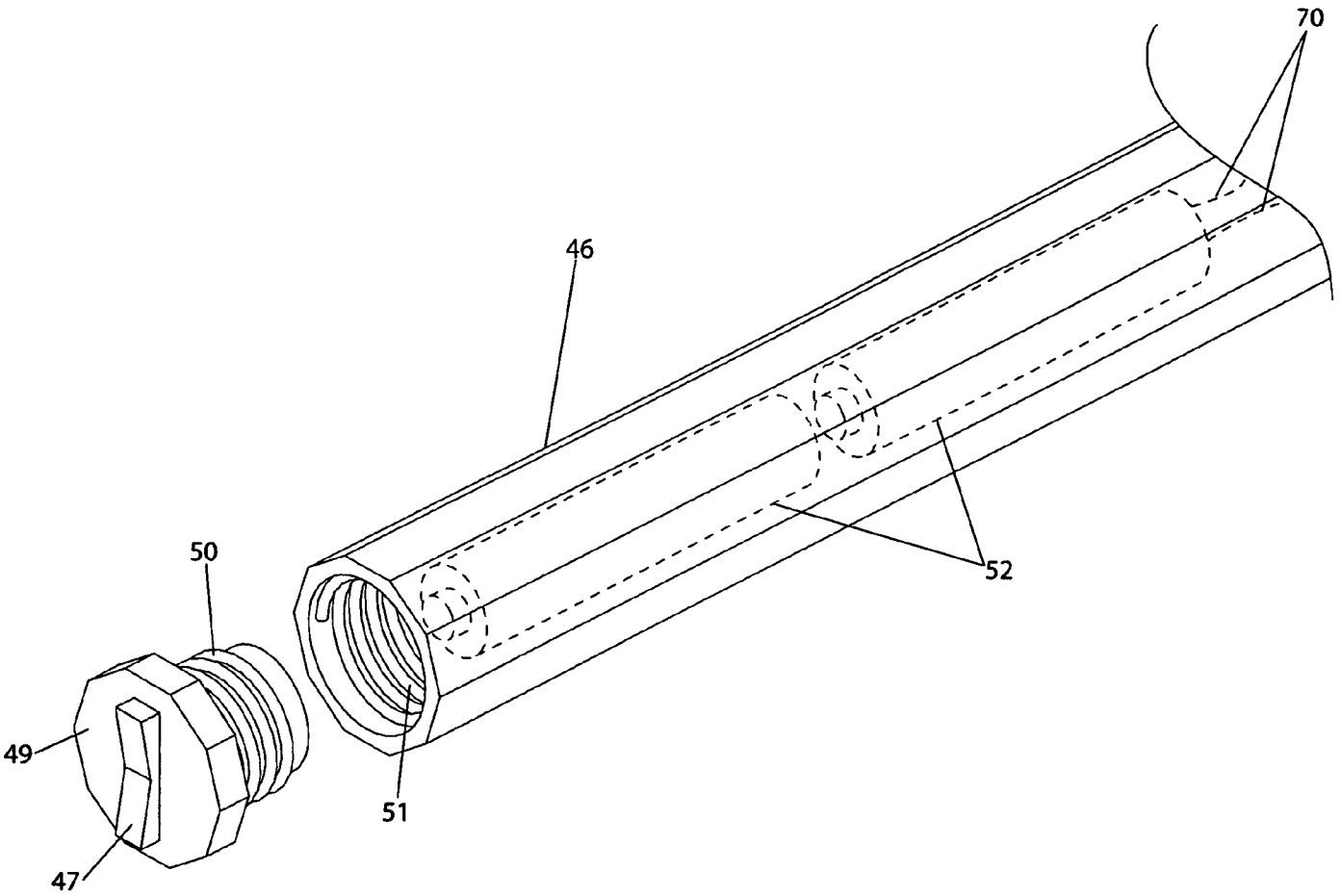
FIG. 6 is a close-up perspective view of a handle 46 of the racquet 45, according to a preferred embodiment of the present invention.
Figure 7:
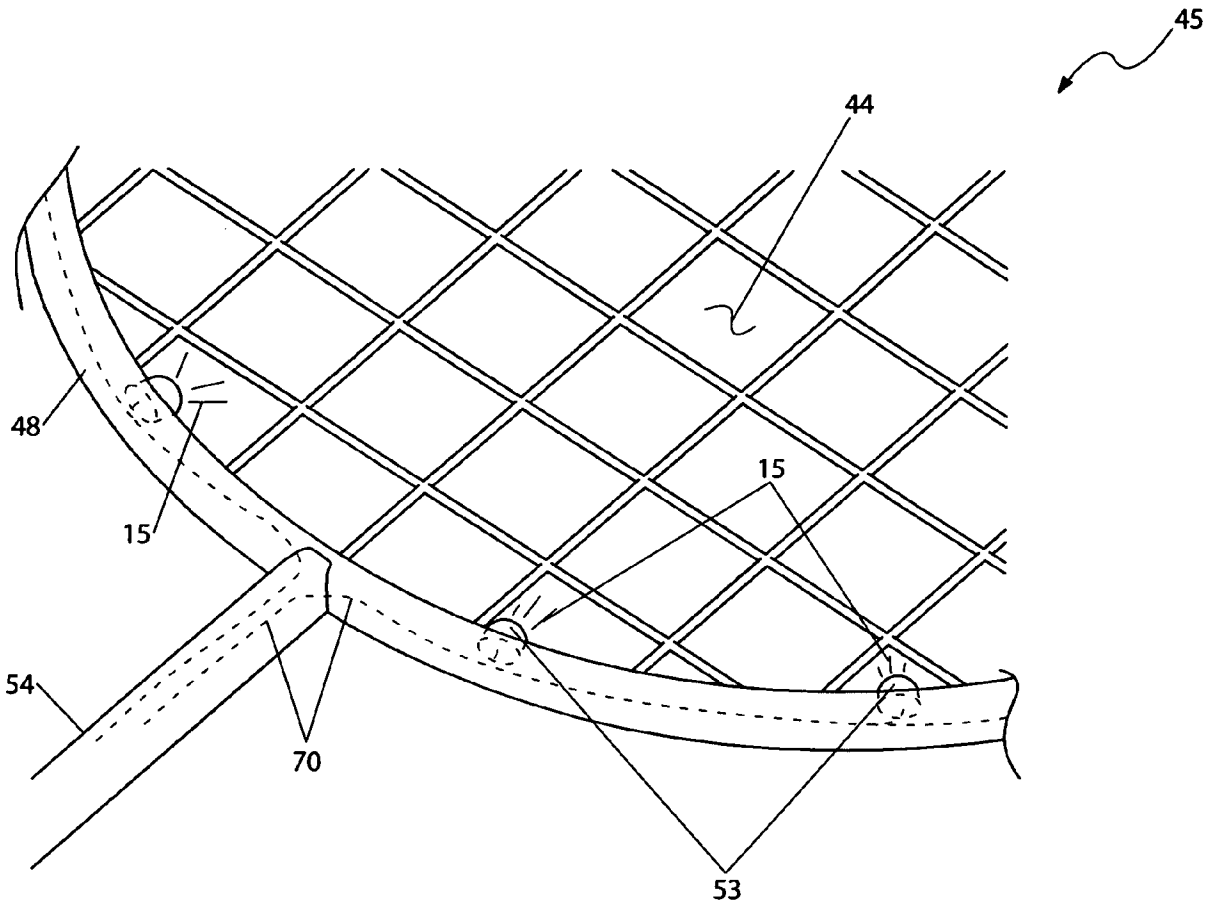
FIG. 7 is a close-up perspective view of a head 48 of the racquet 45, according to a preferred embodiment of the present invention.

Referring now to FIG. 5, a perspective view of the racquet 45, FIG. 6, a close-up perspective view of the handle 46 of the racquet 45, and FIG. 7, a close-up perspective view of the head 48 of the racquet 45, according to the preferred embodiment of the present invention, are disclosed. The system 10 further comprises at least a, pair of racquets 45 which enable at least two (2) players to hit a shuttlecock 50 over the net 30 as required to play the game of badminton. Although illustrated as comprising a pair of racquets 45, it is known that the system 10 may comprise additional racquets 45 for multiple players to participate in the game of badminton. Each racquet 44 comprises a handle 46, a racquet switch 47, a head 48, and a stem 54. The handle 46 provides a gripping surface for the player to comfortably grasp the racquet 45. A racquet switch 47 provides an electrical switching means to the racquet 45 to activate or deactivate a plurality of racquet illumination means 53 to produce an illumination 15 around the head 48 portion. The racquet switch 47 is located at a distal end surface of the handle 46 upon a cap 49 and is comprised of electrical switching devices such as, but not limited to: a pushbutton, a slide switch, a toggle switch or the like. The cap 40 comprises a cap threaded portion 50 which engages a threaded handle internal portion 51. The cap 59 is removed from the handle 46 to access the racquet power source 52. The racquet power source 52 is comprised of user replaceable batteries which supply current to the racquet illumination means 53. The racquet illumination means 53 are preferably LED's which are molded around an inner surface of the head 48 which produces an illumination 15 around said head 48. The head 48 comprises a transparent or translucent material, thereby enabling the illumination 15 to be seen. Electrical wiring 70 is routed from the handle 46, through the stem 54 and through the head 48 to interconnect the racquet power source 52 to the racquet illumination means 53. The handle 46 extends via a stem portion 54 into the oval-shaped or isometric-shaped head 48 which is utilized for securing a plurality of strings 44. The strings 44 enable the shuttlecock 55 to be struck in a normal fashion. The strings 44 are comprised of resilient materials such as, but not limited to: fiber optics, nylon, or the like.

Figure 8:
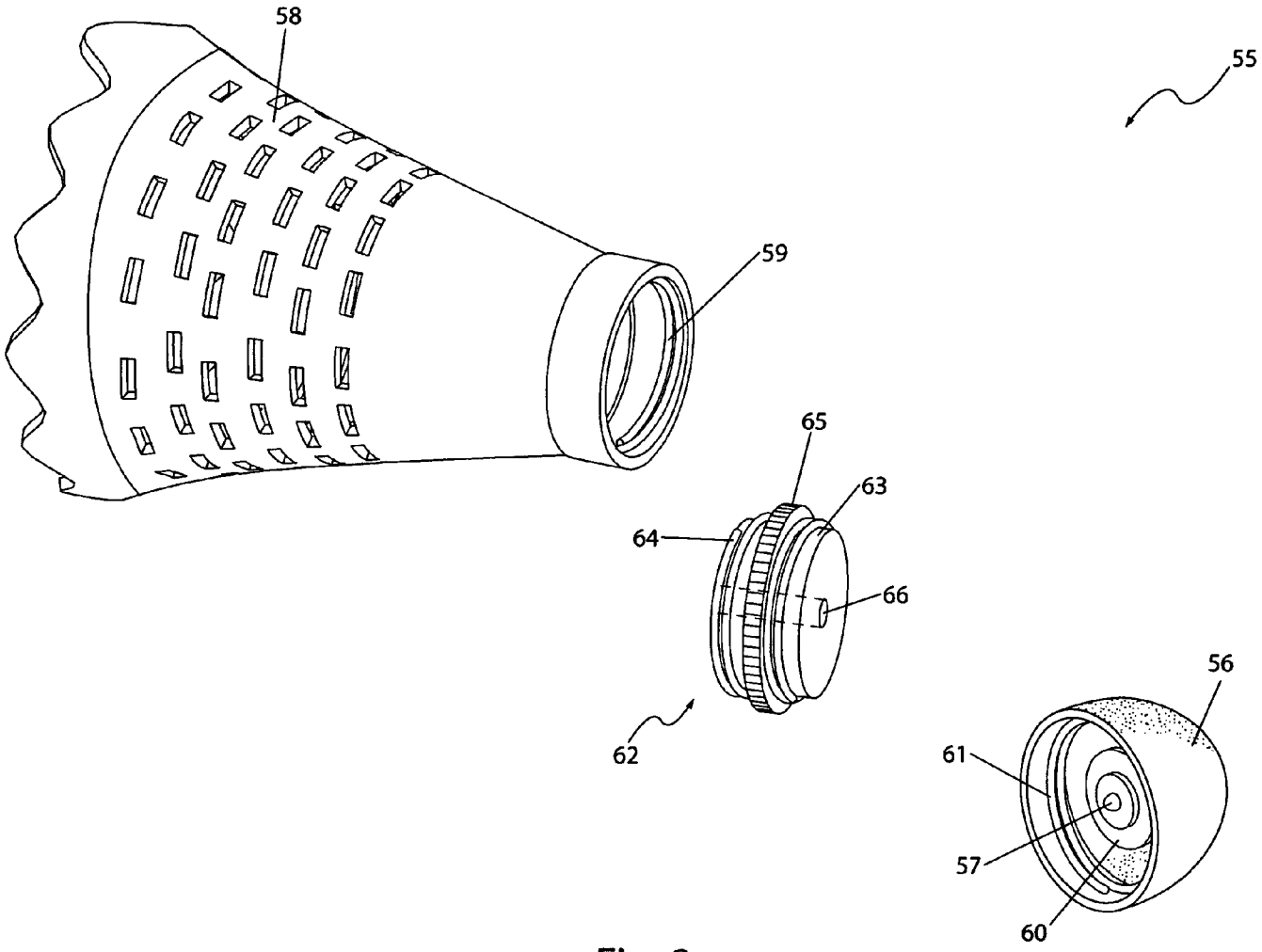
FIG. 8 is an exploded perspective view of the shuttlecock 55, according to a preferred embodiment of the present invention; and, FIG. 9 is a perspective view of a pair of boundary lines 20, according to a alternate embodiment of the present invention.

Referring now to FIG. 8, an exploded perspective view of the shuttlecock 55, according to the preferred embodiment of the present invention, is disclosed. The system 10 yet further comprises a shuttlecock 55 providing an aerodynamic projectile to strike with the racquet 45 over the net 30. The shuttlecock 55 comprises an open conical-shape further comprising a base 56, a skirt 58, and an attachment member 62.

The base 56 provides a weighted surface which is struck via the strings 44 of the racquet 45 and projected over the net 30. The base 56 is fabricated from a translucent rubber or plastic to produce an illumination 15 from the internal shuttlecock illumination means 57. The base 56 is removably attachable for replacing a shuttlecock power source 60 via an inner base threaded portion 61. The shuttlecock power source 60 is a user replaceable battery which is inserted into the base 56 to transmit current to the shuttlecock illumination means 57. Other means of activating and deactivating the shuttlecock illumination means 57 may also be incorporated without limiting the scope of the system 10. The base threaded portion 61 threadably engages a base attachment 66 upon the disc-shaped attachment member 62 (see herein below). The skirt 58 is positioned opposing the base 56 and provides an air drag means to the shuttlecock 55. The skirt 58 is also removably attachable for replacement of as necessary via an inner skirt threaded portion 59 which engages a skirt attachment 64 upon the attachment member 62 (see herein below). The skirt 53 is fabricated from a translucent plastic material or the like. The attachment member 62 is a single unit which comprises a base attachment 63 to attach to the base 56 and a skirt attachment 64 to attach to the skirt 58. Between the base attachment 63 and the skirt attachment 64 is a center grip member 65 which enables the player to grip the exterior surface to remove or put on the base 56 and skirt 58. The attachment member 63 also comprises an illumination means aperture 66 which fits over the shuttlecock illumination means 57 to enable illumination 15 to shine upwardly upon the skirt 58.

Figure 9:
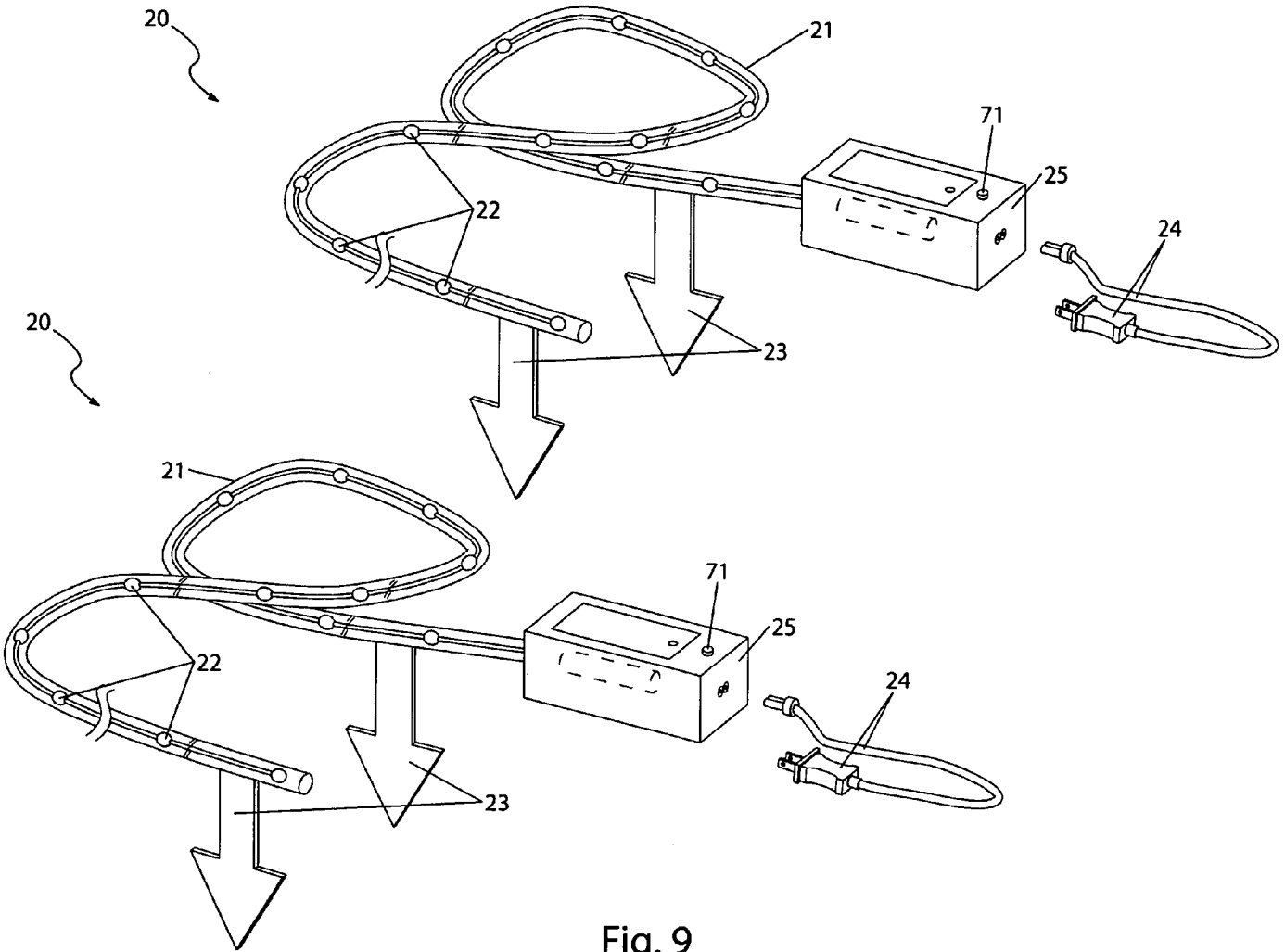

Referring now to FIG. 9, a perspective view of the pair of boundary lines 20, according to the alternate embodiment of the present invention, is disclosed. As abovementioned a pair of boundary lines 20 may be utilized to bisect the playing area 75 in lieu of a single boundary line 20. Each boundary line 20 would be positioned in an opposing orientation in which each boundary line 20 measures approximately twenty (20) feet wide by twenty (20) feet long. Each boundary line 20 comprises a boundary line tube 21 which encloses a length of boundary line illumination means 22 as abovementioned. Each boundary line 20 would also comprises includes a plurality of equally spaced spikes 23 which enable the boundary line 20 to secure to the desired ground surface. Each boundary line 20 would also comprise a respective power cord 24 and battery compartment 25 to supply power to the boundary line illumination means 22.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of utilizing the boundary line 20 may be achieved by performing the following steps: acquiring the boundary line 20; positioning the boundary line 20 on a level surface and inserting the spikes 23 into said level surface; placing a boundary line secondary power source 26 into the boundary line battery compartment 25 as needed; plugging in the boundary line power cord 24 into the boundary line battery compartment 25 as needed; and, transmitting a current to the boundary line illumination means 22 via the boundary line secondary power source 26 or the boundary line power cord 24 as desired and illuminating the boundary line illumination means 22 within the boundary line tube 21 to create illumination 15 around the desired playing area 75.

The method of utilizing the net 30 may be achieved by performing the following steps: acquiring the net 30; positioning each pole 31 at an equidistant width opposing each other and bisecting the playing area 75; attaching the net 30 to each pole 31 via inserting a hook portion **33*b* of each net attachment cord 33*a* into each respective net cord aperture 34; placing a net secondary power source 42 into the net battery compartment 41 as needed; plugging in the net power cord 40 into the net battery compartment 41 as needed; and, transmitting a current to the net 38 illumination means 22 via the net secondary power source 42 or the net power cord 40 as desired and illuminating the net illumination means 38 within the net tube 37 to create illumination 15 around the desired playing area 75 and upon the netting 32**.

The method of utilizing the racquet 45 may be achieved by performing the following steps: acquiring the racquet 45; grasping the racquet 45 at the handle 46 and depressing the racquet switch 47 to illuminate the racquet illumination means 53, head 48, and strings 44 as necessary; disengaging the cap 49 from the handle internal portion 51 to replace the racquet power source as needed; and, repeating for a desired amount of racquets 45.

The method of utilizing the shuttlecock 55 may be achieved by performing the following steps: acquiring the shuttlecock 55; removing the base 56 from the attachment member 62 via disengaging the base threaded portion 61 from the base attachment 63; inserting a shuttlecock power source 60 as needed to illuminate the shuttlecock illumination means 57; replacing the base 56 onto the attachment member; and, removing the skirt 58 from the attachment member 62 via disengaging the skirt threaded portion 59 from the skirt attachment 64 as desired for replacement purposes.

The method of utilizing the system 10 may be achieved by performing the following steps: striking the shuttlecock 55 with the racquets 45 over the net 30; and, participating in the game of badminton at daylight or at nighttime in a conventional manner. The system 10 may also be used during daytime or in adequate light without using the illumination means 15.

The method of utilizing a pair of boundary lines 20 may be achieved by performing the following steps: acquiring a pair of boundary lines 20; positioning a boundary line 20 on a level surface and inserting the spikes 23 into said level surface; positioning another boundary line 20 on a level surface opposing the first boundary line 20 and inserting the spikes 23 into said level surface; placing each boundary line secondary power source 26 into each boundary line battery compartment 25 as needed; plugging in each boundary line power cord 24 into the boundary line battery compartment 25 as needed; and, transmitting a current to the boundary line illumination means 22 via the boundary line secondary power source 26 or the boundary line power cord 24 as desired and illuminating the boundary line illumination means 22 within each boundary line tube 21 to create illumination 15 around the desired playing area 75.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. An illuminated badminton playset, comprising:

a boundary line assembly comprising:

a boundary illumination means;

a boundary line power source comprising a housing, further comprising:

a boundary power cord for removably connecting to a conventional wall-mounted socket;

a boundary transformer circuit in electrical communication with said boundary power cord;

a boundary battery source;

a boundary sensing relay for selectively switching between said boundary transformer circuit and said boundary battery source; and, a boundary power switch in electrical communication with said boundary transformer circuit and said boundary battery source for selectively activating and deactivating said boundary illumination means;

a length of translucent rope boundary lighting tubing;

a corresponding length of said boundary illumination means enclosed within said boundary lighting tubing and in electrical communication with said boundary line power source; and, a plurality of equidistantly-spaced spikes extending outwardly from and longitudinally spaced along said boundary lighting tubing, each capable of engaging a ground surface and anchors said boundary line to said ground surface;

a net assembly comprising:

a net illumination means;

a pair of elongated poles each comprising a pole spike integrally attached upon a proximal end surface capable of being anchored into said ground surface;

a pair of net tube apertures located on at least one of said pair of poles;

a generally rectangular border securely fastened to each of said pair of poles at an upper location and a lower location with a net fastening means;

a netting affixed into interior perimeter sides of said border and enveloping an entire internal area thereof;

a net power source comprising a housing, further comprising:

a net power cord for removably connecting to a conventional wall-mounted socket;

a net transformer circuit in electrical communication with said net power cord;

a net battery source;

a net sensing relay for selectively switching between said net transformer circuit and said net battery source; and, a net power switch in electrical communication with said net transformer circuit and said net battery source for selectively activating and deactivating said net illumination means;

a length of translucent rope net lighting tubing routed through said pair of net tube apertures attached to an exterior perimeter edge of said border providing said net illumination means;

a corresponding length of said net illumination means enclosed within said net lighting tubing and in electrical communication with said net line power source;

at least a pair of racket assemblies, each comprising:

a racket illumination means;

a handle, having a first end and a second end;

a stem, having a first end extending outward from said handle second end;

a head extending outward from a second end of said stem, said head comprising a translucent generally oval body comprising a plurality of strings affixed to inner perimeter surfaces thereof, wherein said racket illumination means is embedded therein;

a cap removably attached to a distal end surface of said handle first end;

a racket power source located within said handle; and, a racquet power switch located on said cap opposite said handle first end and in electrical communication with said racket power source and said racket illumination means for selectively activating and deactivating said racket illumination means; and, a shuttlecock assembly comprising an open conical-shape further comprising:

a shuttlecock illumination means;

an attachment member, comprising a first end having a first attachment means, a grip member, and an opposing second end having a second attachment means;

a weighted base, comprising a translucent body removably attachable to said attachment member first attachment means and further comprising:

a shuttlecock power source retained within said base; and, said shuttlecock illumination means removably attachable to and in electrical communication with said shuttlecock power source; and, a skirt removably attachable to said attachment member second attachment means;

wherein said attachment member further comprises an aperture aligned with said shuttlecock illumination means to enable illumination generated from said shuttlecock illumination means to project onto said skirt;

wherein said grip member enables a user to grasp said shuttlecock during attachment or removal of said base or said skirt;

wherein said shuttlecock illumination means is continuously activated when in electrical communication with said shuttlecock power source;

wherein said boundary line assembly is placed on said ground surface in a generally rectangular configuration, such that a playing area is defined within; and, wherein said net assembly is placed above said boundary line assembly to laterally bisect said playing area.

2. The playset of claim 1, wherein each said boundary illumination means, said net illumination means, said racket illumination means, and said shuttlecock illumination means further comprises a plurality of LED lights.

3. The playset of claim 1, wherein said playing area is approximately 20 feet in width and 40 feet in length.

4. The playset of claim 1, wherein said pair of poles are each approximately 5 feet in length.

5. The playset of claim 1, wherein said net fastening means further comprises a net attachment cord having a first end attached to each adjacent corner of said border and a hook attached to a second end, said hook adapted engage said of each of said pair of poles.

6. The playset of claim 1, wherein said first attachment means and said second attachment means each further comprises a threaded attachment.

7. An illuminated badminton playset, comprising:

a plurality of boundary line assemblies, each comprising:

a boundary illumination means;

a boundary line power source comprising a housing, further comprising:

a boundary power cord for removably connecting to a conventional wall-mounted socket;

a boundary transformer circuit in electrical communication with said boundary power cord;

a boundary battery source;

a boundary sensing relay for selectively switching between said boundary transformer circuit and said boundary battery source; and, a boundary power switch in electrical communication with said boundary transformer circuit and said boundary battery source for selectively activating and deactivating said boundary illumination means;

a length of translucent rope boundary lighting tubing;

a corresponding length of said boundary illumination means enclosed within said boundary lighting tubing and in electrical communication with said boundary line power source; and, a plurality of equidistantly-spaced spikes extending outwardly from and longitudinally spaced along said boundary lighting tubing, each capable of engaging a ground surface and anchors said boundary line to said ground surface;

a net assembly comprising:

a net illumination means;

a pair of elongated poles each comprising a pole spike integrally attached upon a proximal end surface and capable of being anchored to said ground surface;

a pair of net tube apertures located on at least one of said pair of poles;

a generally rectangular border securely fastened to each of said pair of poles at an upper location and a lower location with a net fastening means;

a netting affixed into interior perimeter sides of said border and enveloping an entire internal area thereof;

a net power source comprising a housing, further comprising:

a net power cord for removably connecting to a conventional wall-mounted socket;

a net transformer circuit in electrical communication with said net power cord;

a net battery source;

a net sensing relay for selectively switching between said net transformer circuit and said net battery source; and, a net power switch in electrical communication with said net transformer circuit and said net battery source for selectively activating and deactivating said net illumination means;

a length of translucent rope net lighting tubing routed through said pair of net tube apertures attached to an exterior perimeter edge of said border providing said net illumination means;

a corresponding length of said net illumination means enclosed within said net lighting tubing and in electrical communication with said net line power source;

at least a pair of racket assemblies, each comprising:

a racket illumination means;

a handle, having a first end and a second end;

a stem, having a first end extending outward from said handle second end;

a head extending outward from a second end of said stem, said head comprising a translucent generally oval body comprising a plurality of strings affixed to inner perimeter surfaces thereof, wherein said racket illumination means is embedded therein;

a cap removably attached to a distal end surface of said handle first end;

a racket power source located within said handle; and, a racquet switch located on said cap opposite said handle first end and in electrical communication with said racket power source and said racket illumination means for selectively activating and deactivating said racket illumination means; and, a shuttlecock assembly comprising:

a shuttlecock illumination means;

an attachment member, comprising a first end having a first attachment means, a grip member, and an opposing second end having a second attachment means;

a weighted base, comprising a translucent body removably attachable to said attachment member first attachment means and further comprising:

a shuttlecock power source retained within said base; and, said shuttlecock illumination means removably attachable to and in electrical communication with said shuttlecock power source; and, a skirt removably attachable to said attachment member second attachment means;

wherein said attachment member further comprises an aperture aligned with said shuttlecock illumination means to enable illumination generated from said shuttlecock illumination means to project onto said skirt;

wherein said grip member enables a user to grasp said shuttlecock during attachment or removal of said base or said skirt;

wherein said shuttlecock illumination means is continuously activated when in electrical communication with said shuttlecock power source;

wherein said plurality of boundary line assemblies are placed on said ground surface to effect a generally rectangular configuration, such that a playing area is defined within; and, wherein said net assembly is placed above said plurality of boundary line assemblies to laterally bisect said playing area.

8. The playset of claim 7, wherein each said boundary illumination means, said net illumination means, said racket illumination means, and said shuttlecock illumination means further comprises a plurality of LED lights.

9. The playset of claim 7, wherein said playing area is approximately 20 feet in width and 40 feet in length.

10. The playset of claim 7, wherein said pair of poles are each approximately 5 feet in length.

11. The playset of claim 7, wherein said net fastening means further comprises a net attachment cord having a first end attached to each adjacent corner of said border and a hook attached to a second end, said hook adapted engage said of each of said pair of poles.

12. The playset of claim 7, wherein said first attachment means and said second attachment means each further comprises a threaded attachment.

* * * * *